United States Patent [19]

Reiter

[11] 4,313,473

[45] Feb. 2, 1982

[54] PROCESS AND THREAD INSERTER FOR THE MANUFACTURE OF BELTING WITH TUBULAR EDGE PORTIONS

[75] Inventor: Erich Reiter, Mutlangen, Fed. Rep. of Germany

[73] Assignees: Johann Berger; Josef Berger, both of Schwabisch Gmund, Fed. Rep. of Germany

[21] Appl. No.: 158,808

[22] Filed: Jun. 12, 1980

[30] Foreign Application Priority Data

Jun. 23, 1979 [DE] Fed. Rep. of Germany ..... 2925413
Nov. 8, 1979 [DE] Fed. Rep. of Germany ..... 2945078

[51] Int. Cl.[3] ..... D03D 47/42
[52] U.S. Cl. ..... 139/432; 139/116
[58] Field of Search ..... 139/431, 432, 117, 118, 139/383 R, 116

[56] References Cited

U.S. PATENT DOCUMENTS 4,007,763 2/1977 Sellers et al. ..... 139/432
4,174,738 11/1979 Berger et al. ..... 139/432

FOREIGN PATENT DOCUMENTS 2161013 12/1971 Fed. Rep. of Germany ..... 139/432
2356754 3/1978 France ..... 139/432
2376910 9/1978 France ..... 139/432

*Primary Examiner*—Henry Jaudon
*Attorney, Agent, or Firm*—Cushman, Darby & Cushman

[57] ABSTRACT

The belting has a single layer woven central portion (24) and two tubular edge portions (21, 22) and is made on a needle belt weaving loom provided with a knitting needle (37). The belting serves preferably for safety belts in motor vehicles. One tubular edge portion (22) is closed by a row of stitching (28') whereby the row of stitching does not lie at the outer edge of the tubular edge portion (22) but should disappear into the fabric at the edge of the central portion (24). By means of the invention the rate of production should be increased, which results from manufacture with two simultaneously moving weft thread insertion needles (30, 34) which simultaneously at each pick insert two weft threads (31, 35). To anchor one weft thread at the outer edges of the edge parts a common shed for both weft thread insertion needles is formed at least on the insertion side by the two outer edge warp threads (1*a*, 2*a*). For weaving the edge parts (21', 22') between the central portion (24) and the two outer edge warp threads (1*a*, 2*a*) an upper shed (32*a*) and a lower shed (32*b*) are formed, of which one shed accepts the first weft thread insertion needle (34) which forms the edge fabric and the other the second weft thread insertion needle (30) of which the weft thread (31) binds only with at least one of the two outer edge warp threads (1*a*, 2*a*). A loop (35', 51') is drawn by the knitting needle (37) outside the edge part (22') through a loop (31', 35'') of at least one of the weft threads (31, 35) to form a stitch (28, 65). The row of stitching is formed either from one weft thread (35) or from a catch thread (51). In the latter case a thread inserter (53) serves to feed simultaneously the catch thread (51) and a barrier thread (41). The two weft threads (31, 35) are positively fed and the length fed of the one weft thread (35) is greater by at least the length of the two outer edge parts (21', 22') than the length fed of the other weft thread (31).

15 Claims, 7 Drawing Figures

PROCESS AND THREAD INSERTER FOR THE MANUFACTURE OF BELTING WITH TUBULAR EDGE PORTIONS

BACKGROUND OF THE PRESENT INVENTION

The invention relates to a process for the manufacture of belting having a single layer central portion and tubular edge portions. A process of this kind is known from the German laid-open document (Offenlegunsschrift) No. 27 18 382 of the same applicants now U.S. Pat. No. 4,174,738.

Belting made in this way is used mainly for safety belts in vehicles. The use of a needle belt weaving loom makes the formation of a row of woven stitching to close one tubular edge necessary. According to the publication cited above, the row of stitching is laid at the edge of the central portion and loops of the row of stitching are drawn into the central portion, so that the stitching row practically disappears into the central portion.

The weft thread insertion needle (called hereinafter "weft needle") must enter twice successively into the same shed formed for the central portion. The sheds are reversed only for the edge part, so that each time, one pick forms the edge part fabric and the next takes up only one of the two outside warp threads and then serves to draw back the edge part to make the tubular edge portion.

It is intended by means of the present invention to increase the rate of weft insertion, in particular, to double it and to do it in such a manner that the row of stitching practically disappears into the belting.

The present invention provides a process for the manufacture of belting having a single layer central portion and two tubular edge portions on a needle belt weaving loom provided with a knitting needle, the process comprising the steps of:

(a) weaving both tubular edge portions in the form of single layer edge parts;

(b) forming stitches at the outer edge of one edge part by means of the knitting needle;

(c) closing both edge parts by weft thread tension to form the tubular edge portions;

(d) drawing loops from the stitches pulled to the edge of the central portion into the central portion by weft thread tension, characterized by the following features:

(e) two weft threads are inserted simultaneously at each pick by means of two weft thread insertion needles;

(f) for anchoring one weft thread at the outer edges of the edge parts a common shed for both weft thread insertion needles is formed at least on the insertion side by the two outer edge warp threads;

(g) for weaving the edge parts between the central portion and the two outer edge warp threads an upper and a lower shed are formed, of which one shed accepts the first weft thread insertion needle which forms the edge fabric, and the other shed the second weft thread insertion needle of which the weft thread binds only with at least one of the two outer edge warp threads;

(h) a loop is drawn by the knitting needle outside one of the edge parts through a loop of at least one of the weft threads to form a stitch;

(i) the two weft threads are positively fed and the length fed of the first weft thread is greater by at least the width of the two edge parts than the length fed of the second weft thread.

Instead of a single weft needle, two are used, which are inserted simultaneously at each pick. By this means the rate of weft insertion is doubled for the same warp speed. This means twice the length of belting in unit time.

The process of making the row of stitching is as follows: one of the two wefts forms the edge fabric while the other takes up one of the two outer warp threads.

The knitting needle is so guided that it draws a loop (one of the weft threads or a catch thread) through a loop of the other weft thread or of both weft threads and forms a stitch. By tension on the second weft thread, which picks up only one of the two outer warp threads, the two edge parts are then closed to form tubular edge portions. As described in the prior publication, from the row of stitching formed at one edge part a loop is drawn into the fabric of the central portion.

The different lengths of the two wefts are taken into account, since only one of them forms the tubular edge portions and must therefore be longer than the other, which forms only the central portion.

The use of two weft needles affords the advantage that only half as many stitches need be formed as with the use of a single weft needle. This results in a thinner row of stitching which can be drawn better and more completely into the fabric than a row of stitching formed by a single weft needle. The belting so formed is thus better protected against wearing out of the stitching.

In the German Offenlegungsschrift No. 21 61 013 a weaving process is described in which two weft needles are used and at one edge of the fabric a row of stitching is formed from one weft thread with an auxiliary thread. In this case however no tubular edge portion is formed; instead both weft threads are taken to the edge of the fabric. This publication therefore gives no information on how to proceed if it is required to form a tubular edge portion by the simultaneous insertion of two weft needles, i.e. when the two weft needles have to perform two very different functions.

According to an embodiment of the present invention weft threads of different thickness can be used. Therefore by skilful combination of weft materials of different thickness belting can be made of qualities which do not correspond to normal commercial thicknesses. The thickness of the belt and the transverse stiffness can be selected at will without changing the weft density by the use of two weft threads of different thickness.

According to a further embodiment of the invention a monofilament yarn can be used for the second weft thread. The second weft thread serves to draw in the single layer edge part to form a tubular edge portion, but does not serve to make the edge part fabric. Monofilament yarns are harder than the normally used multifilament yarns. By weaving with monofilament yarns as weft threads, belts with greater transverse stiffness can therefore be achieved, which is very advantageous for coiling in vehicle safety belt automatic reeling equipment. Monofilament yarns would on the other hand exert a greater rubbing effect on the clothing or body of the user of a safety belt if they projected at the edge of the belt. This is avoided in that the monofilament yarn is used only for making the central portion of the belting and to draw the single layer edge part in, while this is itself woven from a multifilament yarn.

By the use of a relatively stiff monofilament yarn for one of the weft threads a smaller number of wefts per cm of belt length can be woven than by the use of two multifilament yarns of the same thickness as the weft threads. By this means a higher production speed is achieved.

In principle there are various possibilities for forming the row of stitching. The two weft threads can be knitted together or one weft thread can be knitted with a catch thread. In both cases the row of stitching can be protected against drawing out by an additional barrier thread.

If a catch thread is used and a thinner yarn is used for the catch thread than for the weft thread, the thickness of the stitching can be still further reduced.

According to one embodiment of the invention, the catch thread and barrier thread can be fed in by one and the same thread inserter, which reduces the constructional cost of the loom.

The invention relates further to a thread inserter for a needle belt weaving loom for carrying out the process according to the aforementioned embodiment. By means of a single thread inserter, which may have two prong-like extensions, the catch thread and barrier thread can be fed in together.

DESCRIPTION OF THE DRAWINGS

Examples of embodiments of the invention are described with the help of the accompanying drawings, in which.

DETAILED DESCRIPTION OF THE PRESENT INVENTION

Figure 1:
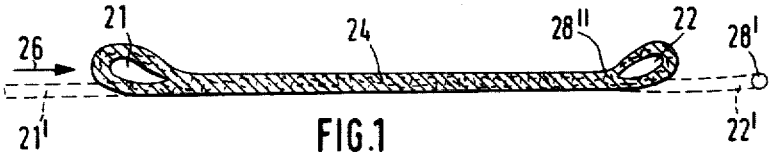
FIG. 1 shows a cross-section of a webbing belt woven in accordance with the invention.

FIG. 1 shows the webbing belt to be manufactured, in cross-section with a left-hand tubular edge portion 21, a right-hand tubular edge portion 22 and a single layer central portion 24. The weft needles are inserted in the direction of the arrow 26 and withdrawn in the opposite direction. Both tubular edge portions are produced first as single layer woven edge parts 21' and 22'. At the free edge of the edge part 22' a row of stitching 28' is formed. Both edge parts are closed by tension on the weft thread to form the tubular edge portions. The row of stitching 28' is thereby displaced to position 28'', where it disappears into the fabric of the webbing. To achieve this, loops from the row of stitching are drawn into the single layer central portion as described in the German Offenlegungsschrift No. 27 19 382 now U.S. Pat. No. 4,174,738.

Figure 2:
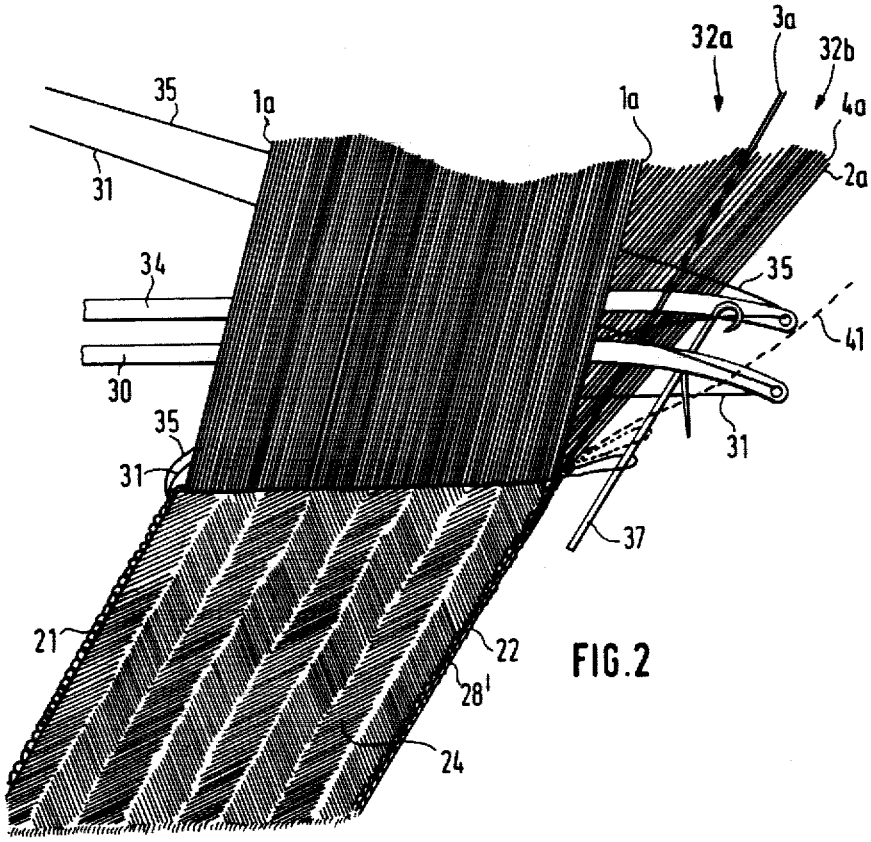
FIGS. 2 and 3 show process steps in the weaving and stitching process whereby two weft threads and a barrier thread are knitted together.
Figure 3:
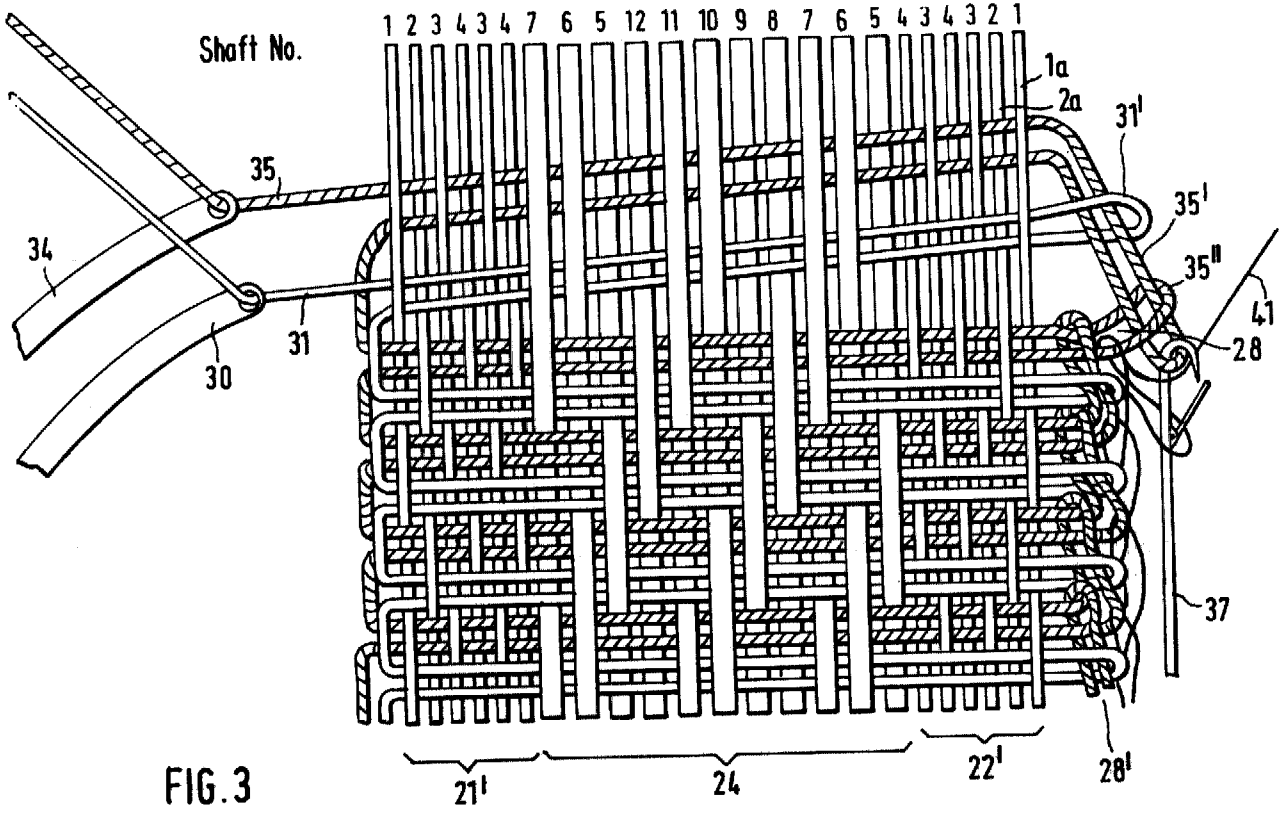
Figure 4:
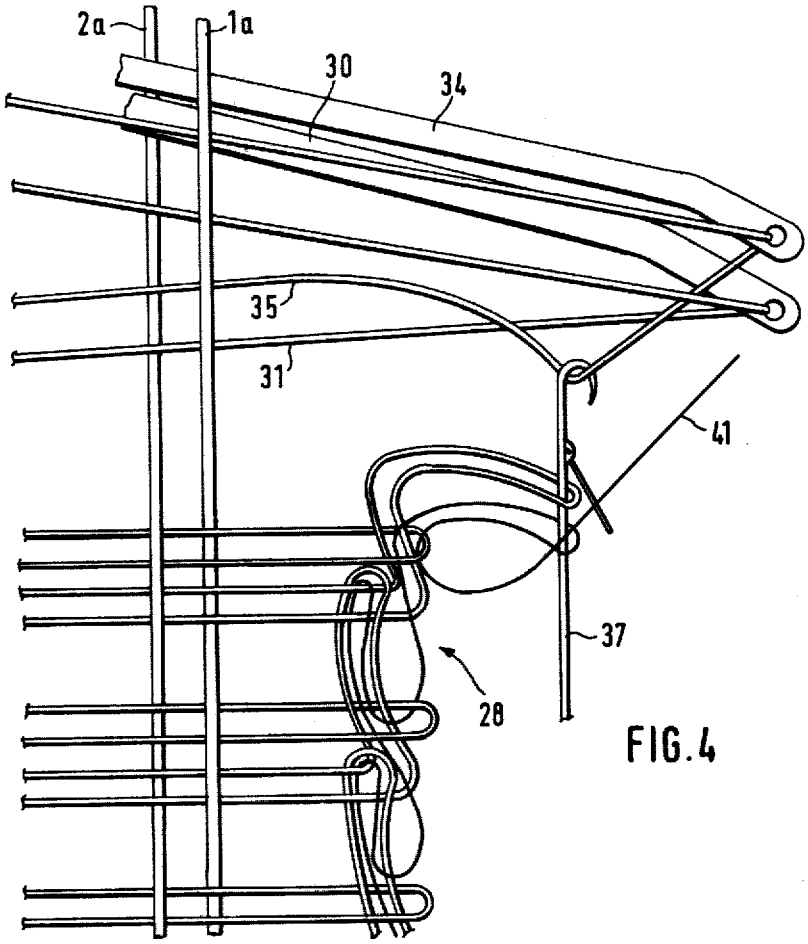
FIG. 4 shows in particular the stitching according to this process with weft loops drawn apart.

In the diagrammatic representation in FIGS. 2 and 3, both in the central portion 24 and in the two edge portions 21' and 22' fewer warp threads are shown than are normally used. FIG. 4 shows only the two outer edge warp threads 1*a* and 2*a*.

Figure 5:
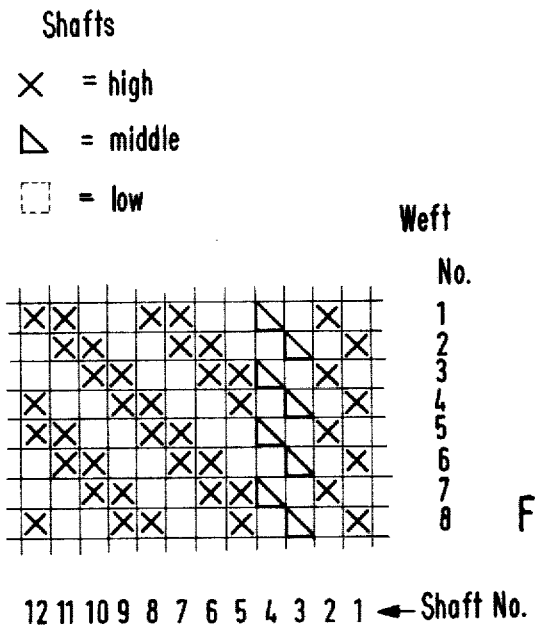
FIG. 5 shows the pattern relating to the central portion of the webbing belt and to the edge parts.

To make the single layer central portion 24 only one shed is needed, which is transposed each time in a known manner to form a twill. The pattern according to FIG. 5 shows this for the shafts numbers 5 to 12. The central portion can however be woven using a double shed.

For the two outer warp threads of the two edge parts 21' and 22' a large shed is formed, modified as for a linen bond, by the two shafts numbers 1 and 2. From the upper weft needle 30 the upper weft thread 31 is inserted into this shed. It binds alternately with the outer and second outer warp threads 1*a* and 2*a* of the edge part 22'.

To produce the fabric of the two edge parts a lower shed 32*b* is formed (FIGS. 2 and 5). Each time half of the warp threads (4*a*) are pulled down by the associated heddles, the other half (3*a*) remain in the neutral position, i.e., in the middle. The lower weft needle 34 carries the lower weft thread 35 into the lower shed 32*b*.

Both weft needles 30 and 34 are inserted simultaneously. At each pick the central portion is woven in twill bond by both weft threads. The two edge parts are woven in linen bond by the lower weft thread 35, while at each pick the upper weft thread 31 binds with one of the two outer warp threads of both edge parts.

To form the row of stitching, the knitting needle 37, which is movably mounted on the needle tape loom, is passed beneath the upper weft needle 30 and between the weft needle 30 and the weft thread 31 from the fabric. The knitting needle 37 is then passed lengthwise above the lower weft needle 34 in such a way that the lower weft thread 35 coming from the fabric inserts itself into its open head. A known type of thread inserter, not represented here, can be used for the purpose of guiding the lower weft thread 35 into the open head of the knitting needle. All three needles 30, 34 and 37 are then withdrawn into the positions shown in FIG. 3, whereby the knitting needle 37 draws a loop 35' of the lower weft thread 35 through a loop 31' of the upper weft thread 31 and by throwing off a loop 35'' remaining on it from a previous pick forms a stitch 28. The loop 35'' is formed from the lower weft thread 35.

Additionally a barrier thread 41 can be worked into the row of stitches 28'. As shown in FIG. 3, the barrier thread 41 is worked up by the knitting needle 37 only with the lower weft thread 35.

The two edge parts 21' and 22' are closed to form tubular edge portions by tension on the upper weft thread 31, which FIG. 3 does not show. The left-hand edge part 21' is closed to the right each time the upper weft needle 30 is inserted; the right-hand edge part 22' is closed on withdrawing the upper weft needle to the left. In the last-named process step the row of stitching 28 is drawn to the right-hand edge of the central portion 24, and each time a loop of the weft thread 35 is drawn by the upper weft thread 31 from the stitching row into the single layer central portion 24.

The knitting needle 37 is swingable round an axle located in the weft direction below the fabric being formed in such a way that it describes a circular arc track of small curvature.

Instead of, as shown in FIG. 3 drawing a loop of the weft thread 35 through a loop of the weft thread 31, with otherwise the same function of the two weft threads the reverse procedure can be adopted, i.e. a loop of weft thread 31 can be drawn through a loop of weft thread 35.

Figure 6:
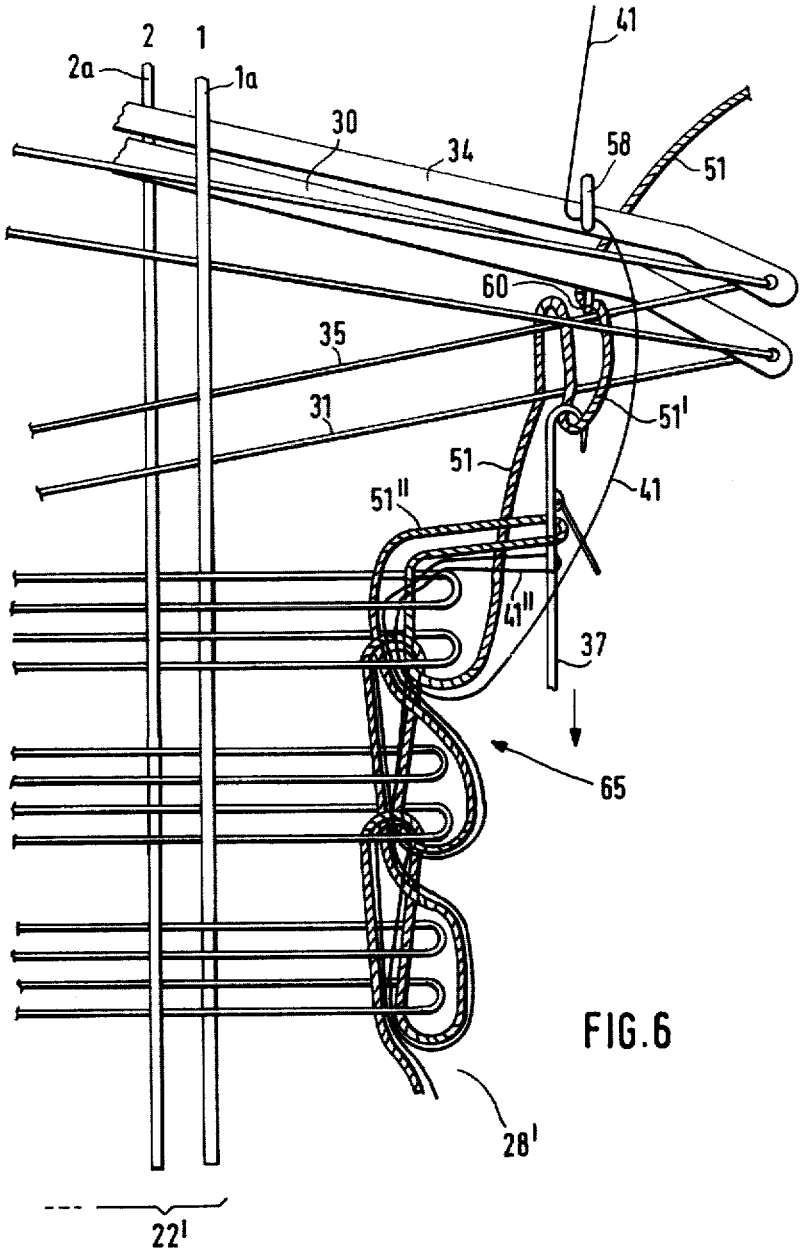
FIG. 6 shows in a presentation corresponding to FIG. 4 a process step in a modified weaving and stitching process whereby a row of stitching is formed from a catch thread and a barrier thread and the weft loops are caught in this row of stitching.

FIG. 6 shows the formation of a row of stitches using a catch thread 51. FIG. 6 shows only the two outer warp threads 1*a* and 2*a* with shafts numbers 1 and 2 and shows very schematically the wefts already inserted and two weft threads 31 and 35, just inserted by the two weft needles 30 and 34. Apart from the special features to be described below, the above explanations apply also to this embodiment.

Figure 7:
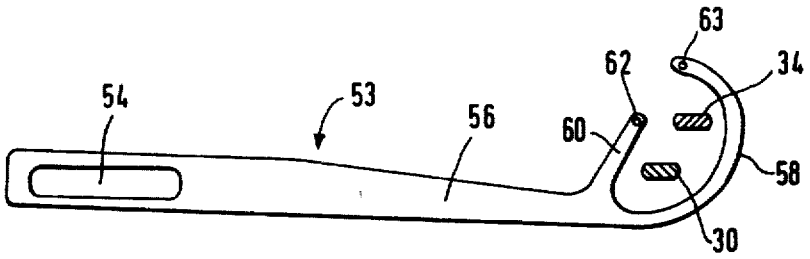
FIG. 7 shows a side view of a thread inserter for catch thread and barrier thread in its top operating position, as used for the process according to FIG. 6.

For feeding together a catch thread 51 and a barrier thread 41 a thread inserter 53 is used (FIG. 7).

The thread inserter is swingable round an axle to be imagined at 54 and running in the direction of the weft. FIG. 7 shows it in its top operating position. The thread inserter has an arm 56 which terminates at its right-hand end in two extensions 58, 60, each with an eye 62, 63 at its free end. The eye 62 serves to feed the catch thread 51 and the eye 63 to feed the barrier thread 41. The extension 58 is curved nearly to a semicircle while the extension 60 is straight and runs approximately in the direction of a diameter of the semicircular extension 58.

FIG. 7 shows the upper operating position of the thread inserter 53 and the two weft needles 30 and 34. As can be seen, in this position the thread inserter encircles both weft needles. It feeds the catch thread 51 from below, but the barrier thread 41 from above, as shown in FIG. 6. A loop 51' of the catch thread is consequently drawn through between the two weft needles 30 and 34 on the one hand and the two weft threads 31, 35 from the fabric on the other hand by the knitting needle 37. A loop 51'' of the catch thread and a loop 41'' of the barrier thread still hang on the knitting needle from the previous pick. When the barrier thread 41 is itself also laid in open head of the knitting needle 37, the two loops 41'' and 51'' are thrown off, forming a new stitch 65.

In both embodiments the length of the weft thread 35 fed must be greater than that of the weft thread 31. While the weft thread 31 in essence forms only the single layer central portion 24, the weft thread 35 must in addition form the fabric of the two edge parts 21', 22'. In the embodiment according to FIGS. 2 and 4 the weft thread 35 must additionally be longer, since in addition it forms the row of stitching 28' and from this row of stitching, loops which are drawn into the single layer central portion.

For satisfactory manufacture of the webbing belt it is consequently necessary to feed both weft threads positively and to provide for different weft thread lengths per pick. Devices which make this possible are known and need not be described here.

I claim:

1. A process for the manufacture of belting having a single layer central portion and two tubular edge portions on a needle belt weaving loom provided with a knitting needle, the process comprising the steps of:

(a) weaving both tubular edge portions in the form of single layer edge parts;

(b) forming stitches at the outer edge of one edge part by means of the knitting needle;

(c) closing both edge parts by weft thread tension to form the tubular edge portions;

(d) drawing loops from the stitches pulled to the edge of the central portion into the central portion by weft thread tension, characterised by the following features:

(e) two weft threads are inserted simultaneously at each pick by means of two weft thread insertion needles;

(f) for anchoring one weft thread at the outer edges of the edge parts a common shed for both weft thread insertion needles is formed at least on the insertion side by the two outer edge warp threads;

(g) for weaving the edge parts between the central portion and the two outer edge warp threads an upper and a lower shed are formed, of which one shed accepts the first weft thread insertion needle which forms the edge fabric, and the other shed the second weft thread insertion needle of which the weft thread binds only with at least one of the two outer edge warp threads;

(h) a loop is drawn by the knitting needle outside one of the edge parts through a loop of at least one of the weft threads to form a stitch;

(i) the two weft threads are positively fed and the length fed of the first weft thread is greater by at least the width of the two edge parts than the length fed of the second weft thread.

2. A process according to claim 1, characterised in that the two weft threads consist of yarns of different thickness.

3. A process according to claim 1 or 2 characterised in that the first weft thread consists of a multifilament yarn and the second weft thread of a monofilament yarn.

4. A process according to claim 1 or 2 characterised by the following features:

(a) the knitting needle draws a loop of one weft thread through a loop of the other weft thread and forms a stitch of the one weft thread;

(b) the length fed of the one weft thread which forms the stitches in addition to the greater length needed for the edge parts, is increased further by the amount needed to form both the stitches and the loop drawn from the stitches into the central portion.

5. A process according to claim 4, characterised in that the stitches are safeguarded by a barrier thread which is worked in with one of the weft threads.

6. A process according to claim 1 characterised in that the knitting needle draws a loop of a catch thread through loops of both weft threads and forms a stitch of the catch thread.

7. A process according to claim 6, characterised in that the stitch is safeguarded by a barrier thread which is worked in with the catch thread.

8. A process according to claim 6 or 7, characterised in that a thinner yarn is used for the catch thread than for the weft thread.

9. A process according to claim 7, characterised by the following features:

(a) the catch thread and the barrier thread are fed with the help of a single thread inserter which partially encircles both weft thread insertion needles at the end of its insertion travel;

(b) the catch thread is guided below and the barrier thread is guided above the two weft thread insertion needles to the knitting needle.

10. A thread inserter for a needle belt weaving loom employing two weft inserting needles comprising:

an arm having one end mounted on said loom so as to be movable toward and away from at least an upper operating position, said arm being forked at its other and free end to define two spaced apart prong-like extensions, each of said extensions having an eye at its outermost end to feed separate threads, respectively, said extensions being shaped so that when said arm is in its upper operating position, said extensions at least partially encircle the two weft needles.

11. A thread inserter as in claim 10 wherein said arm is pivotally mounted to said loom by an axle extending substantially in the direction of the weft threads.

12. A thread inserter as in claim 10 wherein one of said extensions feeds a barrier thread and the other of said extensions feeds a catch thread.

13. A thread inserter as in claims 10 or 11 wherein one of said extensions is shaped substantially in the form of an arc of substantially 180 degrees and the other of said extensions is substantially straight and extends substantially in the direction of a diameter of the arc of said one extension.

14. A thread inserter as in claim 13 wherein said other extension extends about half the length of the line spanning the arc.

15. A thread inserter as in claim 14 wherein the extension shaped as an arc feed a barrier thread and the other straight extension feeds a catch thread.

* * * * *